United States Patent [19]

Zang

[11] 4,326,948

[45] Apr. 27, 1982

[54] COAL LIQUEFACTION

[75] Inventor: Hyung K. Zang, Hopewell Junction, N.Y.

[73] Assignee: Texaco Inc., White Plains, N.Y.

[21] Appl. No.: 179,377

[22] Filed: Aug. 18, 1980

[51] Int. Cl.[3] ..... C10G 21/00; C10G 29/20

[52] U.S. Cl. ..... 208/177; 208/290; 208/298

[58] Field of Search ..... 208/177, 290, 298

[56] References Cited

U.S. PATENT DOCUMENTS

| | | | |
|---|---|---|---|
| 2,761,821 | 9/1956 | Jahnig | 208/298 |
| 2,789,083 | 4/1957 | Hardy | 208/177 |
| 4,040,958 | 8/1977 | Rammler | 208/177 |
| 4,085,029 | 4/1978 | Malek | 208/8 LE |
| 4,132,630 | 1/1979 | Carr | 208/177 |
| 4,148,716 | 4/1979 | Paraskos | 208/177 |
| 4,159,240 | 6/1979 | Malek | 208/177 |

*Primary Examiner*—T. M. Tufariello

*Attorney, Agent, or Firm*—Carl G. Ries; Robert A. Kulason; Robert Knox, Jr.

[57] ABSTRACT

Undissolved solid particles in coal liquefaction product are separated by forming a mixture of the coal liquefaction product, water and a separation promoter and separating the mixture into an upper layer containing coal liquefaction product and separation promoter, an intermediate aqueous layer and a lower layer containing undissolved solid particles.

10 Claims, No Drawings

COAL LIQUEFACTION

This invention is concerned with the liquefaction of coal and more particularly, to the separation of undissolved solid material from enriched solvent.

Coal can be liquefied to produce valuable products by subjecting finely divided coal to solvent extraction in the presence or absence of added hydrogen to produce a mixture of coal extract and solvent and an undissolved coal residue which includes undissolved extractable coal and mineral matter or ash.

The undissolved coal and mineral matter should be separated from the mixture of coal and solvent and conventional separation steps such as filtration or centrifugation leave much to be desired as the fine particle sizes encountered in coal liquefaction processes create numerous difficulties with slow settling in the case of centrifugation and with the plugging of filter pores in the case of filtration.

It is, therefor, an object of this invention to provide an improved coal liquefaction process. Another object of the invention is to provide an improved process for separating finely divided undissolved material from coal liquefaction product. Still another object is to provide an improved gravity settling process for the separation of undissolved solid particles from coal liquefaction product. These and other objects will be obvious to those skilled in the art from the following disclosure.

According to my invention, there is provided a process for the separation of undissolved solid particles from coal liquefaction product which comprises forming a mixture of coal liquefaction product containing undissolved solid particles, water and a separation promoter and then separating the mixture into an upper layer containing coal liquefaction product and separation promoter, an intermediate aqueous layer and a lower layer containing undissolved solid particles.

Any suitable solid fuel may be used as the feedstock for the coal liquefaction step and includes such solid fossil fuels as anthracite, bituminous coal, sub-bituminous coal, liqnite and the like. The solid fuel should be in particulate form and may be ground to a particle size no greater than about one-quarter inch with preferably at least 50% passing through a 200 mesh U.S. standard sieve and still more preferably at least 75% passing through a 200 mesh U.S. standard sieve.

The solvent used in the coal liquefaction process should boil within the range of about 350° to 1000° F. preferably between about 450° to 850° F. and advantageously will contain a considerable amount of hydroaromatic compounds. Once the process has been on stream for some time a suitable boiling range portion of the liquefied coal produced during the solvation step may be recycled thereto. However, at startup the solvent may comprise anthracene oil, creosote oil, a petroleum distillate such as gas oil, tetralin, decalin and/or other hydroaromatic compounds. The solvent should be present in the solvation zone in an amount between about 0.5 and 5 parts by weight per part of coal preferably between about 1 and 4 parts solvent per part of coal by weight. The coal-solvent mixture is heated to a temperature between about 700° and 900° F. in a solvation zone which may comprise a vessel equipped with agitation. In another embodiment of the invention, the agitation may be provided by passing the mixture of finely divided coal and solvent through an elongated heating zone having a length to diameter ratio of at least 100 and preferably at least 1000 under conditions of turbulent flow. The heating in the solvation step may generally be effected under superatmospheric pressure preferably within the range of about 100 to 5000 psig and still more preferably between 500 and 2000 psig.

The liquefaction or solvation of the coal may take place in the presence of added hydrogen. Although the addition of hydrogen is not essential to the operation of the process, it is a preferred mode of operation. The hydrogen added to the liquefaction zone need not necessarily be pure but should contain at least about 30% hydrogen. In this respect the term hydrogen includes impure hydrogen. Examples of suitable gases containing hydrogen are synthesis gas such as that produced by the partial oxidation of a carbonaceous or hydrocarbonaceous material, hydrogen produced as a byproduct in the catalytic reforming of petroleum naphtha and hydrogen produced by electrolosis. The hydrogen calculated as pure hydrogen may be present in the solvation zone in an amount between about 20 and 100 SCF/lb. of coal preferably between 40 and 80 SCF/lb. of coal.

The residence time in the solvation zone may be between 5 minutes and 2 hours and preferably is between about 10 minutes and 90 minutes. The residence time should be long enough to allow for the solvation of about 95% of the organic material present in the coal. It will, therefore, be appreciated by those skilled in the art that the fineness of the grind, the temperature, the pressure and the amount of agitation may all be used to determine the residence time in the solvation zone.

The product of the coal liquefaction is a mixture of liquefied coal extract, solvent and undissolved solids including unconverted organic solids and ash solids. After the solvation has been effected, the mixture is removed from the solvation zone and gaseous material, such as hydrogen or gases formed during the solvation procedure, are flashed from the effluent. Optionally, the lower boiling materials such as those boiling up to about 100° F. may also be removed from the liquefaction product.

To separate undissolved solid particles from the liquefied coal product and solvent, a separation promoter and water are added and the mixture is agitated. The separation promoter should be predominantly paraffinic containing at least about 50% paraffins and may be composed of a relatively pure compound or may be mixtures of paraffins with other hydrocarbon materials such as aromatics, naphthenes, or coal derived liquids and should boil within the range of about 200° to 600° F. Examples of suitable separation promoters are $C_7$–$C_{16}$ normal and isoparaffins either alone or mixtures thereof or mixtures with xylene, tetralin, coal derived liquids and the like. The separation promoter may be present in an amount between about 30% and 300%, preferably between 50% and 200% of the liquefied product. The actual separation conditions are not critical but should be such that the system is in the liquid phase.

The water may also be present in an amount similar to the amount of separation promoter, that is, between about 30% and 300% of the liquefaction product, preferably between 50% and 200%.

After the agitation, the mixture may be allowed to settle in the same vessel or may be transferred to a settling vessel. The mixture rapidly settles into three layers, an upper organic phase containing separation promoter, liquefaction solvent and dissolved coal liquefaction product, an intermediate clarified aqueous phase and a lower remainder containing the undissolved solid particles. The upper organic phase is sent to a distillation tower in which the separation promoter, the liquefaction solvent and the liquefied coal are separated with the first two preferably being recycled to the appropriate location in the process. The aqueous layer may be recycled to the mixer. The bottom phase from the settler which contains the undissolved solid particles is separated and may be concentrated with the concentrate being subjected to partial combustion to produce a gas composed primarily of carbon monoxide and hydrogen. This gas may be used as is to supply hydrogen for the solvation or may be subjected to shift conversion where it is reacted with steam to produce hydrogen and carbon dioxide. After separation of the carbon dioxide, the purified hydrogen may be sent to the solvation or liquefaction zone.

The following examples are submitted for illustrative purposes only and it should not be construed that the invention is restricted thereto.

EXAMPLE I

The analyses of the coal and liquefaction solvent appear below in Table 1.

TABLE 1

| Component Weight % | Coal | Liquefaction Solvent |
|---|---|---|
| Carbon | 52.2 | 90.9 |
| Hydrogen | 4.4 | 6.0 |
| Nitrogen | 0.91 | 0.56 |
| Sulfur | 0.53 | 0.58 |
| Moisture | 6.3 | — |
| Ash | 20.1 | — |
| Oxygen (by difference) | 15.56 | 1.96 |

A coal liquefaction run was made in a 2 gallon batch autoclave. Reaction conditions were 850° F., 2000 psig $H_2$ (cold), 90 minutes reaction period and a solvent to coal weight ratio of 2.

The components of liquefaction product are conventionally defined by solubility characteristics as follows. The portion of liquefaction product which is soluble in n-heptane and boils between 450°–750° F. is defined as liquefaction solvent. Asphaltenes are toluene solubles and n-heptane insolubles and pre-asphaltenes are pyridine solubles and toluene insolubles of the liquefaction product respectively. Pyridine insolubles are defined as solids which include unconverted coal and ash. The liquefaction product produced in this example had 69.4% liquefaction solvent, 11.5% asphaltenes, 3.7% pre-asphaltenes and 15.3% solids. In a series of four runs, a mixture of these liquefaction products, separation promoter and water in a 1:2:2 weight ratio was charged to a 200 ml. graduated cylinder and shaken for 15 minutes at 70° F. and left for settling. The separation into three phases took place in less than 5 minutes, an organic layer containing the separation promoter and liquefaction solvent forming at the top, an aqueous phase in the middle and the remainder including unconverted coal and ash at the bottom. The organic and aqueous phases were decanted into a separatory funnel and each phase was separated. A summary of conditions and results of the settling is shown in Table 2. In Runs 1–4 the separation promoter is n-heptane and in Run 5, n-decane.

TABLE 2

| Run No. | 1 | 2 | 3 | 4 | 5 |
|---|---|---|---|---|---|
| Wt. of Liquefaction Products, g. | 31.42 | 26.76 | 26.26 | 30.23 | 35.14 |

TABLE 2-continued

| Run No. | 1 | 2 | 3 | 4 | 5 |
|---|---|---|---|---|---|
| Wt. of Separation Promoter, g. | 62.84 | 53.52 | 52.52 | 60.46 | 70.28 |
| Wt. of Water, g. | 62.84 | 53.52 | 52.52 | 60.46 | 70.28 |
| Separation Results | | | | | |
| Wt. of organic phase, g. | 75.78 | 63.09 | 60.26 | 72.97 | 89.92 |
| Wt. of aqueous phase, g. | 63.99 | 54.20 | 53.06 | 60.15 | 70.05 |
| Wt. of bottoms, g. | 12.63 | 11.59 | 11.0 | 12.32 | 10.83 |
| Solids in organic phase, g. | 0.64 | 0.78 | 0.28 | 0.51 | 0.15 |
| Material Balance, % | 97.4 | 96.9 | 94.9 | 96.2 | 97.3 |
| Recovered Liquefaction Solvent from organic phase, % of liquid solvent present in liquid products | 91.2 | 99.5 | 82.3 | 98.1 | 44.4 |
| Recovery of separation promoter from organic phase, % of charge | 40.4 | 51.8 | 60.3 | 81.5 | 112.3 |

EXAMPLE II

This example is similar to Example I but differs in that the composition of the liquefaction solvent was carbon 90.6%, hydrogen 7.2%, nitrogen 0.47%, sulfur 0.067%, oxygen 1.663% and the liquefaction conditions were 800° F., 1000 psig $H_2$ (cold), 90 minutes reaction period and a solvent to coal weight ratio of 2. Analysis of the liquefaction product showed 85.0% liquefaction solvent, 4.3% asphaltenes, 0.3% pre-asphaltenes and 10.4% unconverted coal and ash. In Table 3 below are shown the results of settling at 200° F. using n-decane as the separation promoter. In this example, as in Example I, after the shaking, the separation was relatively rapid, the three phases forming in less than 5 minutes settling time.

The separation promoter was evaporated from the upper organic phase, which had been separated from the aqueous phase, to determine the weight of liquefaction solvent present in the organic phase. This weight is divided by the weight of liquefaction solvent present in the liquefaction products to determine the recovery of the recycled solvent in the organic phase. The bottom phase contains some water and small amounts of liquefaction solvent and separation promoter.

TABLE 3

| Run No. | 1 | 2 | 3 | 4 |
|---|---|---|---|---|
| Wt. of liquefied products, g. | 33 | 38 | 38 | 32 |
| Wt. of promoter (n-decane), g. | 66 | 38 | 76 | 32 |
| Wt. of water, g. | 33 | 38 | 38 | 32 |
| Temperature, °F. | 200 | 200 | 200 | 200 |
| Residence time, hr. | 2 | 2 | 8 | 8 |
| Results of Settling | | | | |
| Wt. of organic phase, g. | 77.26 | 57.4 | 91.9 | 47.6 |
| Wt. of aqueous phase, g. | 29.19 | 33.5 | 35.0 | 27.3 |
| Wt. of bottoms, g. | 14.18 | 17.5 | 22.7 | 17.6 |
| Material Balance, % | 91.4 | 95.1 | 98.4 | 96.5 |
| Recovered liquefaction solvent from organic phase, % of liquefaction solvent in liq. prod. | 81.9 | 88.2 | 83.0 | 79.9 |
| Analysis of Bottom, % | | | | |
| $H_2O$ | 17.5 | 26.6 | 30.7 | 30.6 |
| Separation Promoter | 7.1 | 7.6 | 16.4 | 13.1 |
| Liquefaction Solvent | 7.1 | 9.8 | 3.9 | 6.0 |
| Asphaltenes | 18.8 | 4.9 | 5.2 | 6.0 |
| Pre-Asphaltenes | 11.7 | 7.1 | 18.2 | 10.4 |
| Uncoverted coal & ash | 37.7 | 44.0 | 26.4 | 33.9 |

An experiment to compare the settling rates with and without water was conducted. The coal liquefaction product used in the series of runs was prepared from the same coal used in Examples I and II under liquefaction conditions of 800° F., 1000 psig hydrogen pressure at room temperature, 2700 psig at reaction temperature, a solvent to coal ratio of 2 and a reaction time of 90 minutes. The coal liquefaction product had 86.3% liquefaction solvent or oils with the 13.7% remainder being made up of 4.4% asphaltenes, 3.4% pre-asphaltenes and 5.9% unconverted coal and ash. The liquefaction products, together with n-decane in a 2:1 volume ratio were charged into a glass column 1 inch in diameter by 26 inches long to make a settling medium 21 inches long. The mixture was shaken manually for 15 minutes and then left upright for settling. Samples were taken at various time intervals from a sampling port located 12½ inches below the initial level. Table 4 below shows the concentration of solids in the settling samples determined by extracting the samples for 24 hours in pyridine. These solids include unconverted coal and ash. The data in Table 4 shows that it took at least 30 minutes for the solid concentration in the settling samples to drop below 5 weight percent.

TABLE 4

| Run | A | B | C |
|---|---|---|---|
| Wt. of liquefaction products, g. | 230.8 | 230.8 | 227.2 |
| Wt. of n-decane, g | 63.5 | 66.9 | 66.4 |
| Settling Temperature, °F. | 70 | 70 | 70 |
| Settling Pressure | ATMOSPHERIC | | |
| Settling Time, minutes | Wt. % solids (unconverted coal and ash) | | |
| 10 | 5.3 | 6.4 | 5.7 |
| 20 | 5.7 | 6.7 | 5.6 |
| 30 | 6.3 | 6.9 | 5.4 |
| 60 | 0.9 | 0.5 | 2.0 |

EXAMPLE III

By way of comparison, when the same liquefaction product used above to demonstrate the settling time in the absence of water was charged to the glass column with water and n-decane in a volume ratio of 2 parts of liquefaction products to 1 part of water and 1 part of n-decane and shaken for 15 minutes and then left upright for settling at a temperature of 70° F. and atmospheric pressure the separation was practically instantaneous with 3 separate phases being formed in less than 5 minutes. Data from this series of runs appear below in Table 5.

TABLE 5

| Run | D | E | F |
|---|---|---|---|
| Wt. of liquefaction products, g. | 129 | 54.23 | 150 |
| Wt. of n-decane, g. | 55 | 27.11 | 150.1 |
| Wt. of water, g. | 92 | 54.35 | 149.8 |
| Settling Temperature, °F. | 70 | 70 | 200 |
| Wt. of organic phase, g. | 83.34 | 40.69 | 224.8 |
| Wt. of solids in organic phase, g. | 0.85 | * | * |

TABLE 5-continued

| Run | D | E | F |
|---|---|---|---|
| Wt. of aqueous phase, g. | 83.38 | 51.46 | 168.3 |
| Wt. of bottom, g. | 104.28 | 36.28 | 61.0 |
| Recovery of recycle solvent, % | 25.5 | 29.0 | 73.1 |
| Material recovery, Wt. % | 98.2 | 94.6 | 105.3 |

*non detectable

It is apparent from the foregoing that the separation of solid matter from coal liquefaction products using a separation promoter and water is far superior to separation in the absence of added water.

Various other modifications of the invention as herein before set forth may be made without departing from the spirit and scope thereof, and therefore, only such limitations should be made as are indicated in the appended claims.

I claim:

1. A process for the production of a coal liquefaction product of reduced solids content which comprises subjecting coal to liquefaction treatment, mixing the liquefaction zone effluent containing undissolved solid particles with water and a hydrocarbon separation promoter and separating the mixture into an upper layer containing coal liquefaction product and separation promoter, an intermediate aqueous layer and a lower layer containing undissolved solid particles.

2. The process of claim 1 in which the liquefaction is carried out in the presence of added hydrogen.

3. The process of claim 2 in which the added hydrogen is produced by subjecting the undissolved solid particles to partial oxidation to produce a gas comprising carbon monoxide and hydrogen.

4. The process of claim 3 in which the gas comprising carbon monoxide and hydrogen is used as produced as the added hydrogen.

5. The process of claim 3 in which the gas comprising carbon monoxide and hydrogen is subjected to shift conversion to produce a gas comprising hydrogen and carbon dioxide, the hydrogen is separated from the carbon dioxide and used as the added hydrogen.

6. The process of claim 1 in which the separation promoter is predominantly paraffinic.

7. The process of claim 6 in which the separation promoter comprises $C_7$–$C_{16}$ normal and isoparaffins.

8. The process of claim 7 in which the separation promoter comprises $C_7$–$C_{10}$ normal and isoparaffins.

9. The process of claim 1 in which the separation promoter is present in an amount between about 30 and 300% of the liquefied product by weight.

10. The process of claim 1 in which the water in the mixture is present in an amount between about 30 and 300% by weight of the liquefaction product.

* * * * *